US010600597B2

(12) United States Patent
Ullermann et al.

(10) Patent No.: US 10,600,597 B2
(45) **Date of Patent: *Mar. 24, 2020**

(54) MINIATURE SAFETY SWITCH

(71) Applicant: ELLENBERGER & POENSGEN GMBH, Altdorf (DE)

(72) Inventors: Wolfgang Ullermann, Schwabach (DE); Helmut Kraus, Berg (DE)

(73) Assignee: Ellenberger & Poensgen GmbH, Alfdorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/150,770

(22) Filed: Oct. 3, 2018

(65) Prior Publication Data

US 2019/0035582 A1 Jan. 31, 2019

Related U.S. Application Data

(63) Continuation of application No. 13/849,745, filed on Mar. 25, 2013, which is a continuation of application No. PCT/EP2011/001809, filed on Apr. 12, 2011.

(30) Foreign Application Priority Data

Sep. 24, 2010 (DE) ..... 20 2010 013 526 U

(51) Int. Cl.

| | |
|---|---|
| ***H01H 37/60*** | (2006.01) |
| ***H01H 37/54*** | (2006.01) |
| ***H01H 71/16*** | (2006.01) |

(52) U.S. Cl.

CPC ..... *H01H 37/60* (2013.01); *H01H 37/5409* (2013.01); *H01H 71/164* (2013.01); *H01H 2037/5463* (2013.01)

(58) Field of Classification Search

CPC ..... H01H 37/60; H01H 37/5409; H01H 2037/5463; H01H 71/164

USPC ..... 337/337

See application file for complete search history.

(56) References Cited

U.S. PATENT DOCUMENTS

| | | | |
|---|---|---|---|
| 4,808,965 | A | 2/1989 | Cenky |
| 5,078,115 | A | 1/1992 | Yamashita et al. |
| 5,153,552 | A | 10/1992 | Krasser |
| 5,428,336 | A | 6/1995 | Smith et al. |
| 5,585,774 | A | 12/1996 | Bennett |
| 5,604,476 | A | 2/1997 | Schmidt et al. |
| 5,607,610 | A | 3/1997 | Furukawa |
| 5,897,055 | A | 4/1999 | Saur et al. |
| 6,144,541 | A | 11/2000 | Kato et al. |

(Continued)

FOREIGN PATENT DOCUMENTS

| | | |
|---|---|---|
| CN | 1282089 A | 1/2001 |
| DE | 19852578 C1 | 4/2000 |

(Continued)

*Primary Examiner* — Jacob R Crum

(74) *Attorney, Agent, or Firm* — Laurence A. Greenberg; Werner H. Stemer; Ralph E. Locher

(57) ABSTRACT

A miniature safety switch is used in motor vehicle electronics. The miniature safety switch has a housing base, from which a fixed contact arm and a bimetallic contact arm, which has a moving contact and a bimetallic snap disk attached thereto, are led out. A PTC resistor is brought into direct contact with the bimetallic snap disk by a compression spring and is electrically integrated in such a way that, as a result of the heat generated by the PTC resistor, the bimetallic snap disk remains in the open position thereof in the event of triggering.

10 Claims, 8 Drawing Sheets

(56) References Cited

U.S. PATENT DOCUMENTS

| | | | |
|---|---|---|---|
| 6,191,680 | B1 | 2/2001 | Hofsaess |
| 6,396,381 | B1 | 5/2002 | Takeda |
| 6,590,489 | B1 | 7/2003 | Ullermann et al. |
| 7,808,361 | B1 | 10/2010 | Yu |
| 8,576,042 | B2 | 11/2013 | Ullermann |
| 2005/0122205 | A1 | 6/2005 | Stiekel et al. |
| 2005/0174211 | A1 | 8/2005 | Takeda |

FOREIGN PATENT DOCUMENTS

| | | | |
|---|---|---|---|
| DE | 202009010473 | U1 | 2/2010 |
| EP | 0938116 | A2 | 8/1999 |
| EP | 1388604 | A1 | 2/2004 |
| EP | 2025983 | A2 | 2/2009 |
| GB | 2203245 | A | 10/1988 |
| GB | 2308510 | A | 6/1997 |
| JP | H03203184 | A | 9/1991 |
| JP | H0745169 | A | 2/1995 |
| JP | H08502850 | A | 3/1996 |
| JP | 2002532826 | A | 10/2002 |
| WO | 2010034373 | A1 | 4/2010 |

MINIATURE SAFETY SWITCH

CROSS-REFERENCE TO RELATED APPLICATION

This is a continuation application of U.S. patent application Ser. No. 13/849,745, filed Mar. 25, 2013, which was a continuation, under 35 U.S.C. § 120, of international application No. PCT/EP2011/001809, filed Apr. 12, 2011, which designated the United States; this application also claims the priority, under 35 U.S.C. § 119, of German patent application No. DE 20 2010 013 526.5, filed Sep. 24, 2010; the prior applications are herewith incorporated by reference in their entireties.

BACKGROUND OF THE INVENTION

Field of the Invention

The invention relates to a miniature safety switch for use in motor vehicle electronics. A miniature safety switch is known from German utility model DE 20 2009 010 473 U1.

Miniature safety switches of this type are increasingly replacing the blade-type fuses previously used as standard in the automotive industry. These fuses are standardized in terms of their geometric dimensions. The standard still valid in this regard in Germany is DIN 72581-3. The international standard ISO 8820 is currently applicable to this field. The latter standard defines three sizes for the blade-type fuses, namely "Type C (medium)", "Type E (high current)" and "Type F (miniature)". Here, a safety switch that is compatible in terms of its geometric dimensions with a socket for a blade-type fuse, in particular a blade-type fuse of Type F according to ISO 8820, is generally referred to as a miniature safety switch.

Safety switches of the above-mentioned type normally contain a bimetallic snap disk as a trigger mechanism, which suddenly and reversibly changes between two curved positions according to temperature. The bimetallic snap disk is fixedly connected to a bimetallic contact in a fixing point. The free end of the bimetallic snap disk remote from the fixing point forms or carries a moving contact, which bears against a corresponding fixed contact provided the temperature prevailing in the safety switch lies below a temperature threshold value. In this case, an electrically conductive path between the bimetallic contact and the fixed contact is thus closed by the bimetallic snap disk. As soon as the temperature prevailing in the safety switch exceeds the temperature threshold value as a result of an overcurrent, the bimetallic snap disk suddenly changes its shape, whereby the moving contact is lifted from the fixed contact and the current path is thus disconnected.

Furthermore, three types of safety switches are defined in US standard SAE 553 for the 12 V and 24 V on-board power supply system. A switch according to Type 1 (automatic reset) opens in the event of an overcurrent and closes again automatically without user intervention after a specific period of time (normally once the bimetal has cooled again). In the event of another overcurrent, the switch is opened and closed cyclically. A switch according to Type 2 (modified reset) remains open after an overcurrent trigger until a minimum voltage is present. Some opening and closing cycles are allowed until the switch is ultimately left open. A switch according to Type 3 (manual reset) is disconnected in the event of overcurrent, and the circuit can be closed again by manual intervention, normally by means of a push-button. The present case in particular concerns a Type 2 safety switch.

In the miniature safety switch known from German utility model DE 20 2009 010 473 U1, a heating resistor, for example a PTC resistor, positioned at a distance from the bimetallic snap disk and having a positive temperature coefficient is soldered to the contact arms by surface mounted device (SMD) technology. The bimetallic snap disk is held open after an overcurrent trigger (trigger event) by the SMD or PTC resistor electrically connected in parallel to the bimetallic snap disk by maintaining a low current flow across the heating resistor in the event of an overload or short circuit, even once the safety switch has been triggered, and the thermal loss generated as a result in the heating resistor is used to heat the bimetallic snap disk.

A disadvantage of this construction with a PTC resistor fixedly soldered on is that a spacing from the bimetallic snap disk is practically unavoidable and therefore the bimetallic snap disk has to be heated by means of air. A high energy input is therefore necessary to maintain the temperature of the bimetallic snap disk after an overcurrent trigger so as to counteract cooling below the return temperature and thus prevent the bimetallic snap disk from snapping back and closing the circuit.

In accordance with a further possibility for producing a safety switch according to SAE Type 2, the bimetal can be provided with a heating winding, wherein this heating winding is also connected electrically in parallel to the bimetal. The bimetal is held open after an overcurrent trigger of the bimetal by heating the winding, which releases the heat to the bimetal. Since the winding bears against the bimetal, a good thermal transfer is achieved. However, electrical insulation between the bimetal and the winding is to be ensured, for example in the form of glass-fiber insulation or a film (for example Kapton), which limits the thermal transfer however and requires a high level of cost and in particular hinders automated production.

SUMMARY OF THE INVENTION

It is accordingly an object of the invention to provide a miniature safety switch which overcomes the above-mentioned disadvantages of the prior art devices of this general type, which can be easily produced and is particularly functionally reliable in terms of an undesired snapback of the bimetallic snap disk.

With the foregoing and other objects in view there is provided, in accordance with the invention a miniature safety switch for use in motor vehicle electronics. The miniature safety switch contains a housing having a housing base made of an insulating material and a housing cover that can be fitted, or is fitted, on the housing base. First and second elongate and flat contact arms disposed parallel to one another in terms of a longitudinal direction, are disposed in the housing base and being led at a base side from the housing base. A fixed contact is disposed in the housing and attached to the first contact arm. A bimetallic snap disk having a moving contact is attached to the second contact arm. A compression spring is supported on the first contact arm beneath the fixed contact in the longitudinal direction. A PTC resistor is electrically incorporated such that, as a result of heat generated by the PTC resistor, the bimetallic snap disk remains in an open position thereof in an event of triggering. The PTC resistor is brought into direct contact with the bimetallic snap disk by the compression spring.

Proceeding from a miniature safety switch of the type mentioned in the introduction, the PTC resistor is brought into direct contact with the bimetallic snap disk by a compression spring, while the compression spring is supported on the first contact arm beneath the fixed contact.

In accordance with a particularly advantageous embodiment, the compression spring, the resilience of which presses the PTC resistor inside the housing against the bimetallic snap disk, is formed as a conical spring. The conical spring has a base-side spring end of relatively large spring diameter and an apex-side spring end of relatively small spring diameter and will therefore also be referred to hereinafter as a volute spring. The volute spring bears appropriately via its base-side spring end against the contact arm inside the housing, while the apex-side spring end of the conical spring preferably bears centrally against the PTC resistor. In combination with this embodiment of the compression spring as a conical or volute spring, the PTC resistor is preferably circular and, to this end, is embodied as a resistor disk or plate. The disk diameter of the PTC resistor is again suitably adapted to the relatively large spring diameter of the conical spring and is expediently at least approximately identical to the diameter thereof at the base-side spring end.

This embodiment enables a particularly compact design of the spring and of the resistor, which in turn results in a particularly low spatial requirement of these components within the miniature safety switch. This configuration and model also enables the provision of a particularly effective pivot or tilt point in the contact area of the compression spring, in which the apex-side spring end of the spring having the small spring diameter bears against the PTC resistor. To this end, the arrangement of these two components (compression spring and PTC resistor) within the housing or within the housing base is selected in terms of construction in such a way that the compression spring engages the PTC resistor in the region of the midpoint thereof. It can thus be ensured that the compression spring also then bears centrally against the PTC resistor and thus reliably maintains its position when, as the safety switch is triggered, the bimetallic snap disk springs back from the fixed contact, thus opening the moving contact, the PTC resistor being able to pivot about the central tilt point formed by the apex-side spring end and remaining pressed against the bimetallic snap disk as a result of the resilience.

As part of an advantageous embodiment of the compression or conical spring and also of the PTC resistor under consideration both of the confined installation space conditions and the necessary functionality, a diameter of the compression or conical spring at the apex-side spring end thereof of approximately 2 mm and at the base-side spring end thereof of approximately 4 mm as well as a disk diameter of the PTC resistor of (4.2±0.1) mm and a disk thickness of the PTC resistor of (1.05±0.06) mm have proven to be particularly expedient.

So as to easily and reliably produce sufficient positional stability of the compression spring within the housing and also on the housing base, the housing base has a pocket-like base contour, which is provided in a housing crosspiece running in the transverse direction relative to the contact arm. While the first contact arm carrying the fixed contact is guided through this base contour in the longitudinal direction and therefore interrupts it centrally, the compression spring with its spring end facing the contact arm lies in the pocket-like base contour and in doing so is supported on two sides by the remaining contour half-shells of the base contour. The base contour and the two contour half-shells are dimensioned in such a way that the upper and lower apertures in the longitudinal direction formed in order to pass through the contact arm are smaller in width in the transverse direction than the greatest diameter of the compression spring.

The bimetallic snap disk is attached to the second contact arm at a fixing point, which is aligned in the longitudinal direction with the two contacts (fixed contact and moving contact), wherein the PTC resistor is arranged in the longitudinal direction between the fixing point and the contacts. This again enables central contact between the PTC resistor and the bimetallic snap disk in a simple manner. In addition, this construction ensures reliable contacting of the PTC resistor to the first contact arm via the compression spring and to the second contact arm via the bimetallic disk. In the event of triggering, a current thus flows across the PTC resistor, as a result of which the PTC resistor is heated.

So as to reliably prevent the bimetallic disk from snapping back once the safety switch has been triggered, a temperature at the bimetallic disk of approximately 180° Celsius has proven to be necessary. So as to ensure this temperature at the bimetallic snap disk in the event of triggering, a material that ensures heating of the PTC resistor to a temperature of approximately 275° Celsius as thermal loss as a result of the current flowing across this resistor in the event of triggering is particularly expedient for the PTC resistor.

The advantages achieved with the invention lie in particular in the fact that, due to the arrangement of a PTC resistor in direct contact with a bimetallic snap disk of a miniature safety switch with the aid of a compression spring that is as space-saving as possible, the bimetallic snap disk, in the event of triggering, experiences a sufficient thermal input from the PTC resistor to reliably prevent the bimetallic disk from snapping back in an undesired manner. The forming of the compression spring as a conical spring makes it possible to minimize the installation space necessary therefor since the spring coils of the spring lie within one another as the spring is pressed together. As a result of a suitable constructional embodiment of the conical or volute spring as a conical spring body with spring coils that slide within one another when the spring is pressed together, the height (block length) of the compression or conical spring when pressed together can preferably be limited to two times the spring wire diameter by winding inwardly the spring free end of the greatest coil diameter at the base-side spring end of the conical spring.

Voltage ranges of a 12 V on-board power supply system of a motor vehicle for example from approximately 11 V to approximately 14.5 V can be reliably covered with the miniature safety switch according to the invention. Due to the full-area and direct contact of the PTC resistor against the bimetallic disk, produced or assisted by the compression spring, it is ensured that, at the relatively low voltages, the energy is sufficient to hold the bimetallic disk in the open position. In this case the power output (P=Uxl) of the non-linear PTC resistor is always sufficiently high. In addition, there is no risk that, at relatively high voltages, the resultant high temperature of the PTC resistor desolders the resistor or even damages the resistor, or that the safety switch as a whole could become too hot. The miniature safety switch according to the invention also ensures that the temperature range normally required in the automotive industry from −40° C. to +85° C. is reliably covered.

Other features which are considered as characteristic for the invent ion are set forth in the appended claims.

Although the invention is illustrated and described herein as embodied in a miniature safety switch, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
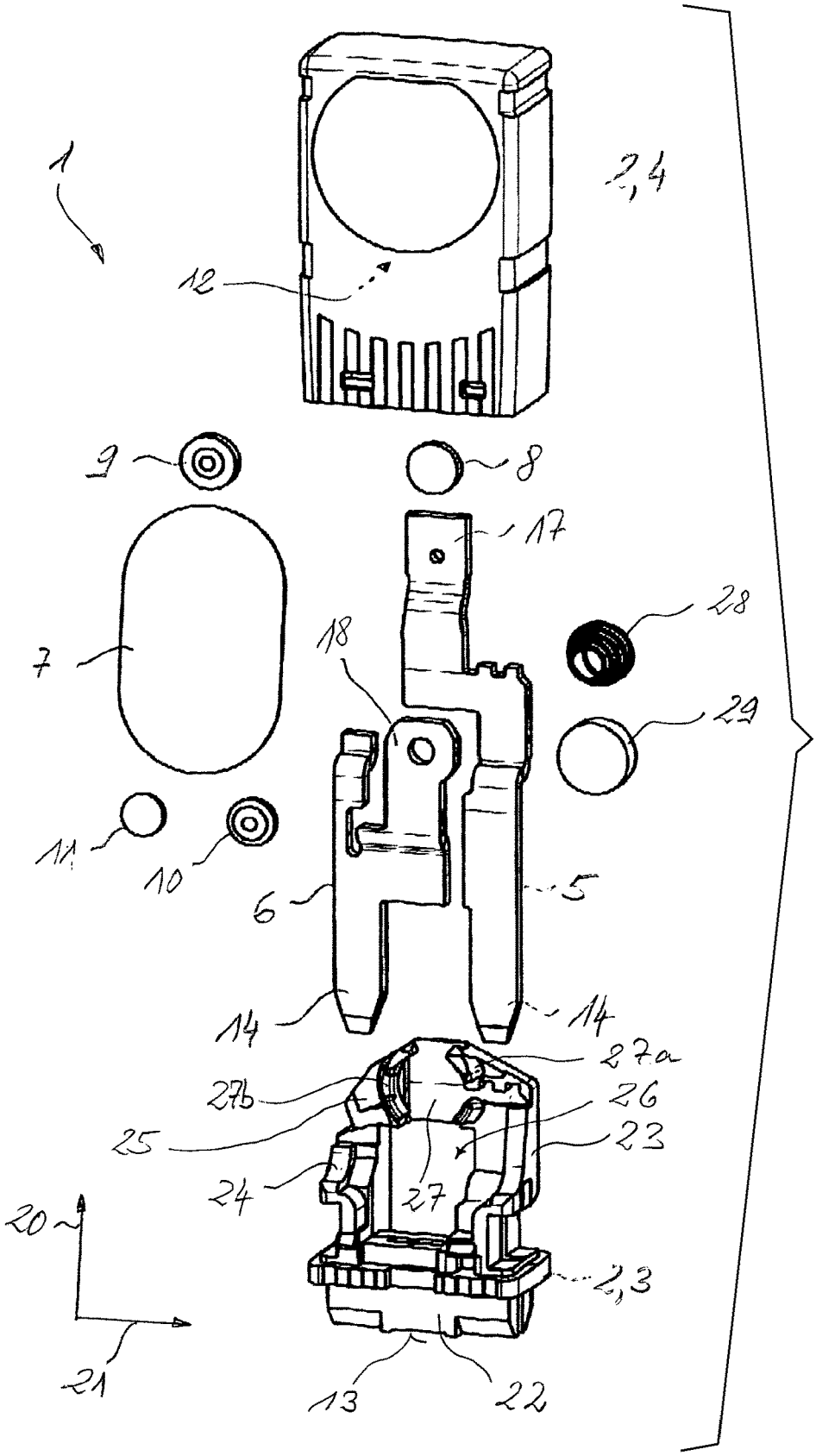
FIG. 1 is a diagrammatic, exploded perspective view of a safety switch having a housing formed from a housing base and a housing cover, two contact arms partially embedded in the housing base, a bimetallic snap disk, a heating resistor (PTC resistor) and a volute spring according to the invention.

Corresponding parts are always denoted in all figures by like reference signs. Referring now to the figures of the drawing in detail and first, particularly, to FIG. 1 thereof, there is shown a safety switch 1 that contains a housing 2, which is formed from a housing base 3 and a housing cover 4. The safety switch 1 further contains a fixed contact arm 5, a bimetallic contact arm 6 and a bimetallic snap disk 7. The safety switch 1 also contains a fixed contact 8 in the form of a weld plate, a moving contact 9 in the form of a further weld plate, and, to fix the bimetallic snap disk 7, a further rivet 10 and a further weld plate 11.

Figure 2:
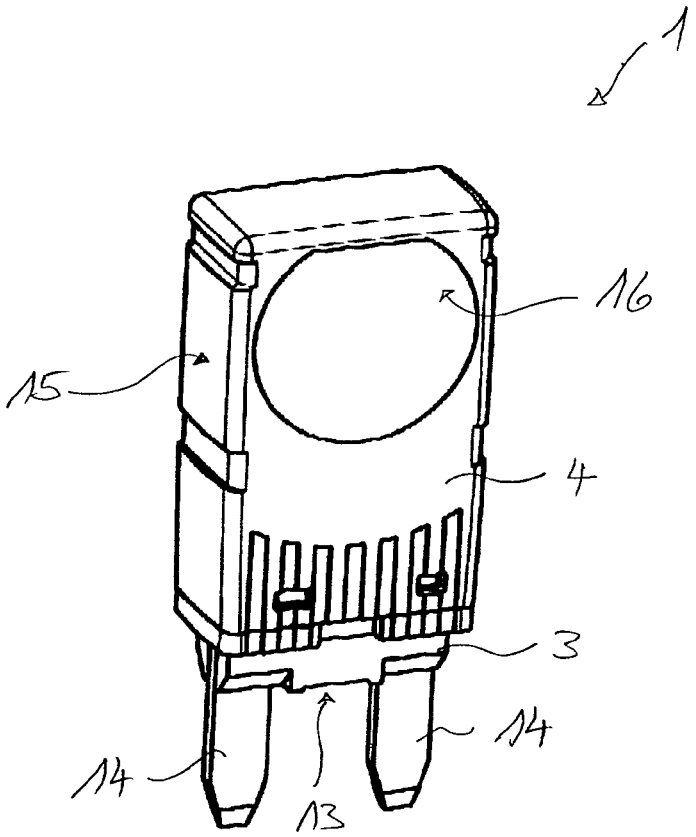
FIG. 2 is a perspective view of the safety switch according to FIG. 1 in the assembled state with a closed housing.

The housing base 3 and the housing cover 4 are fabricated from an electrically insulating material, namely a thermoplastic. The one-piece housing cover 4 is pot-shaped or cap-like and thus surrounds a volume, which defines an interior 12 of the safety switch 1, with five closed walls. The housing cover 4 can be snapped onto the housing base 3 via its open side. FIG. 2 shows the safety switch 1 with a closed housing 2, that is to say with the housing cover 4 fitted onto the housing base 3.

The contact arms 5 and 6 are bent, stamped parts made of sheet metal, in particular tin-plated brass, with a flat, rectangular cross section. The fixed contact arm 5 and the bimetallic contact arm 6 are embedded with an interlocking fit in the housing base 3 since, when the safety switch 1 is produced, the contact arms 5 and 6 are insert-molded with the material of the housing base 3. In this case, the contact arms 5 and 6 each protrude out from the housing base 3 via a plug-in contact 14 at an underside 13 of the housing base 3. The housing 2 and in particular the housing cover 4 are shaped for example in the manner of a flat cuboid with a (housing) narrow side 15 and a (housing) broad side 16. The contact arms 5 and 6 are embedded in the housing base 3 in such a way that the plug-in contacts 14 are arranged parallel to one another, approximately centrally with respect to the housing narrow side 15 and at a distance from one another.

The safety switch 1 is based on standard ISO 8820 Type F (miniature) in terms of its outer geometric dimensions. The miniature safety switch 1 therefore corresponds externally to a Type F blade-type fuse according to this standard, and therefore the safety switch 1 is compatible with a socket for such a blade-type fuse, that is to say can be plugged into such a socket, which is conventional in the automotive industry.

With regard to the housing broad side 16, the plug-in contacts 14 of the contact arms 5 and 6 are each arranged at the edge, whereas they are guided, in each case, inwardly in the housing interior 12 toward the center of the housing so that an inner end 17 of the fixed contact arm 5 is arranged above an inner end 18 of the bimetallic contact arm 6. In this case, "above", means the side of the safety switch 1 remote from the housing base 3 and the plug-in contacts 14, irrespective of the actual orientation of the safety switch 1 in space. As can be seen in particular from FIGS. 3 and 4, the inner ends 17 and 18 of the contact arms 5 and 6 are centered with regard to a central longitudinal axis 19 (FIG. 3) of the housing 2, as viewed from the housing broad side 16.

Figure 3:
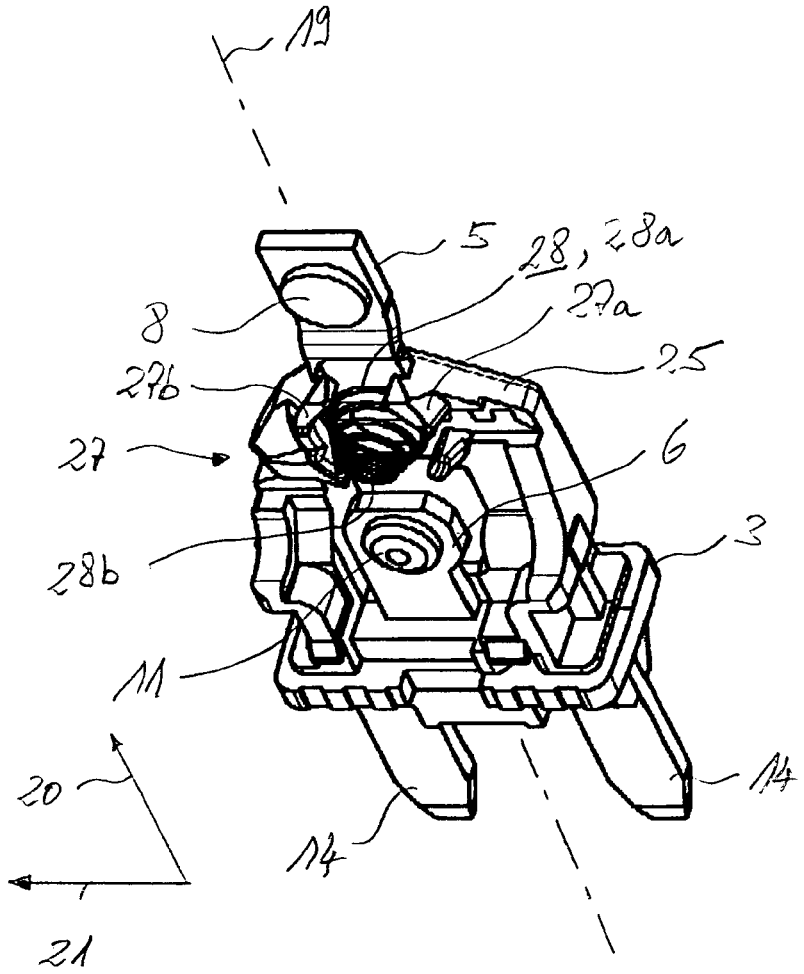
FIG. 3 is a perspective view of the safety switch according to FIG. 1 in a partly assembled state with the volute spring inserted in the housing base, without the PTC resistor and the bimetallic snap disk.
Figure 6:
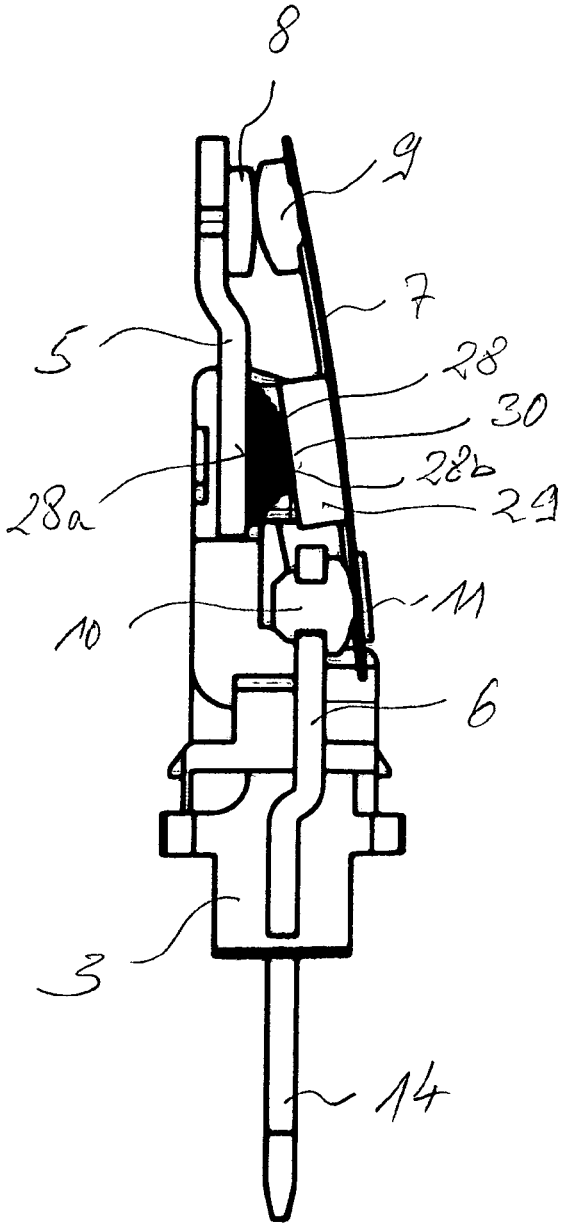
FIG. 6 is a side view of the safety switch according to FIG. 1 in the assembled state without a housing cover in an (electrically conductive) normal state.
Figure 7:
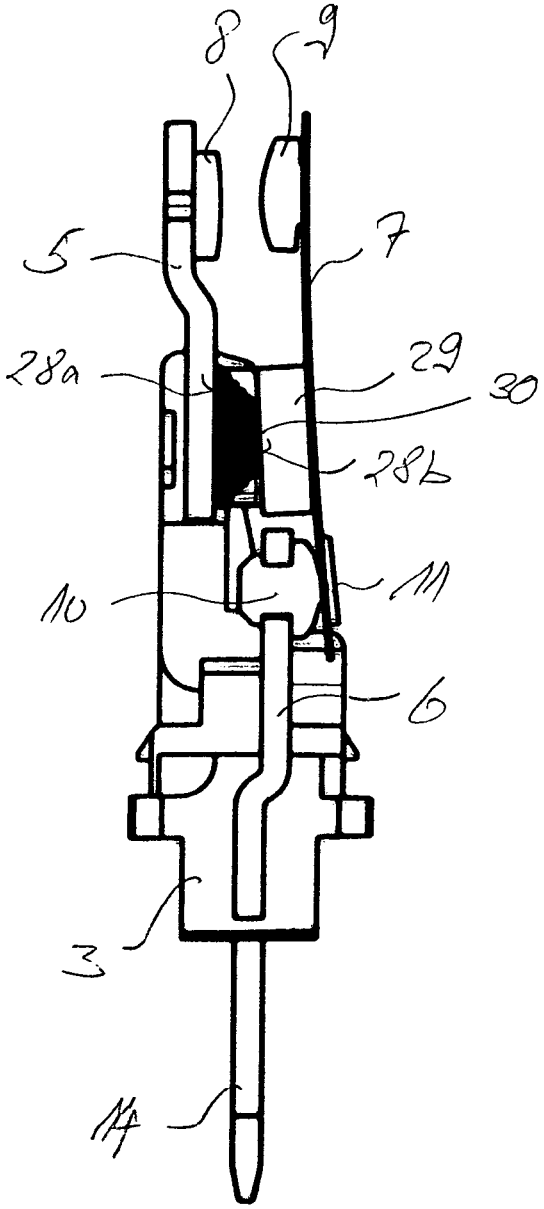
FIG. 7 is a side view according to FIG. 6 of the safety switch according to FIG. 1 in a triggered state.

As is relatively clear from FIGS. 3, 6 and 7, the inner ends 17 and 18 of the contact arms 5 and 6 are bent out from the central plane of the safety switch 1, defined by the plug-in contacts 14, by offset portions of the stamped, bent parts, as viewed from the housing narrow side 15, and extend in a slightly offset manner parallel to the central plane or central longitudinal axis 19. In this case, the inner end 17 of the fixed contact arm 5 is set back relative to the central plane (central longitudinal axis 19), whereas the inner end 18 of the bimetallic contact arm 6 is forward of the central plane (central longitudinal axis 19). The longitudinal extension of the contact arms 5 and 6, and in particular of the plug-in contacts 14 of these contact arms 5 and 6, defines a longitudinal direction 20, while a transverse direction 21 runs perpendicular thereto within the central plane.

The housing base 3 has a base 22 running in the transverse direction 21 and two mutually spaced base struts 23, 24 extending in the longitudinal direction 20 as well as another base crossmember 25 extending in the transverse direction 21 and connecting the base struts at the upper ends thereof. The base struts 23, 24, in which the fixed contact arm 5 and the bimetallic contact arm 6 are embedded, and the base 22 as well as the base crossmember 25, also referred to hereinafter as a base crosspiece, define there between a window-like base cavity 26. The rivet 10, on which the bimetallic snap disk 7 is welded by the weld plate 11, is fixed in this region to the inner end 18 of the contact arm 6 at a distance from the housing base 3. The fixed contact 8 is welded onto the fixed contact arm 5 above this fixing point 10, 11 formed by the rivet and weld plate in the longitudinal direction 20 and therefore in alignment with the fixing point in the longitudinal direction 20.

A base contour 27 referred to hereinafter as a receiving pocket is molded into the base crosspiece 25, is located in the assembled state between the fixing point 10, 11 and the fixed contact 8 in the longitudinal direction 20, and is penetrated by the fixed contact arm 5 in the longitudinal direction 20 (FIG. 3). Two semi-circular base shells 27*a* and 27*b* are thus formed, wherein the distance there between, or the clear width there between, is determined by the width of the fixed contact arm 5.

In the assembled state, a compression spring 28 in the form of a volute spring referred to hereinafter as a conical spring for short lies in the receiving pocket 27 via its base-side spring end 28*a*. The cross-sectional free area of the receiving pocket 27, which is laterally defined by the base shells 27*a* and 27*b* in the transverse direction 21, is adapted to the relatively large spring diameter of the base-side spring end 28*a* of the conical spring 28. The conical spring 28 is thus horizontally positioned in the housing base 3 and sufficiently held at least in a simplified and reliable manner. An apex-side spring end 28*b* of the conical spring 28 opposite the base-side spring end 28*a* protrudes into the interior 12 of the safety switch 1 in the subassembly step shown in FIG. 3. FIG. 3 shows the relaxed state of the conical spring 28.

Figure 4:
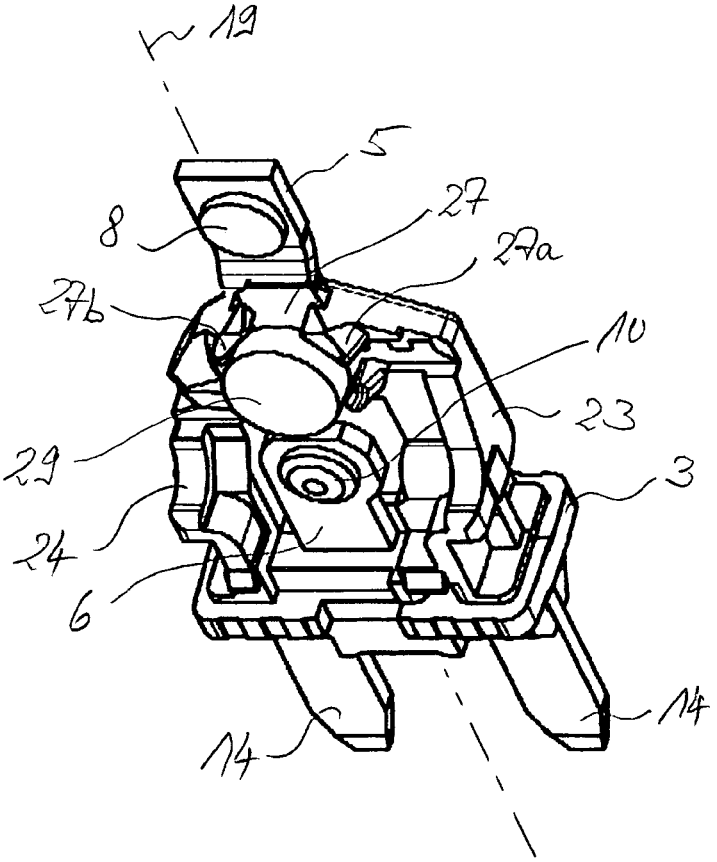
FIG. 4 is a perspective view of the safety switch according to FIG. 1 in the partly assembled state according to FIG. 3, but with the PTC resistor.

FIG. 4, in a further subassembly step, shows the use of a PTC resistor 29 (referred to hereinafter simply as a resistor) within the safety switch 1 in the housing base 3. The resistor 29 is embodied as a circular plate (resistor plate or resistor disk). The diameter of the plate-shaped or disk-shaped resistor 29 is again suitably adapted to the inner diameter (clear width) of the receiving pocket and is thus held in the housing base 3 in an accurately positioned manner, again by the base pockets 27*a*, 27*b* as a result of the lateral delimitation when the conical spring 28 is pressed together. In accordance with FIGS. 3 and 4, it can be seen that the conical spring 28 and the resistor 29 are arranged on the contact arm 6 aligned in the longitudinal direction 20 and preferably centered with the central axis 19 between the fixed contact 8 and the rivet 10 used in the assembled state as a fixing point.

Figure 5:
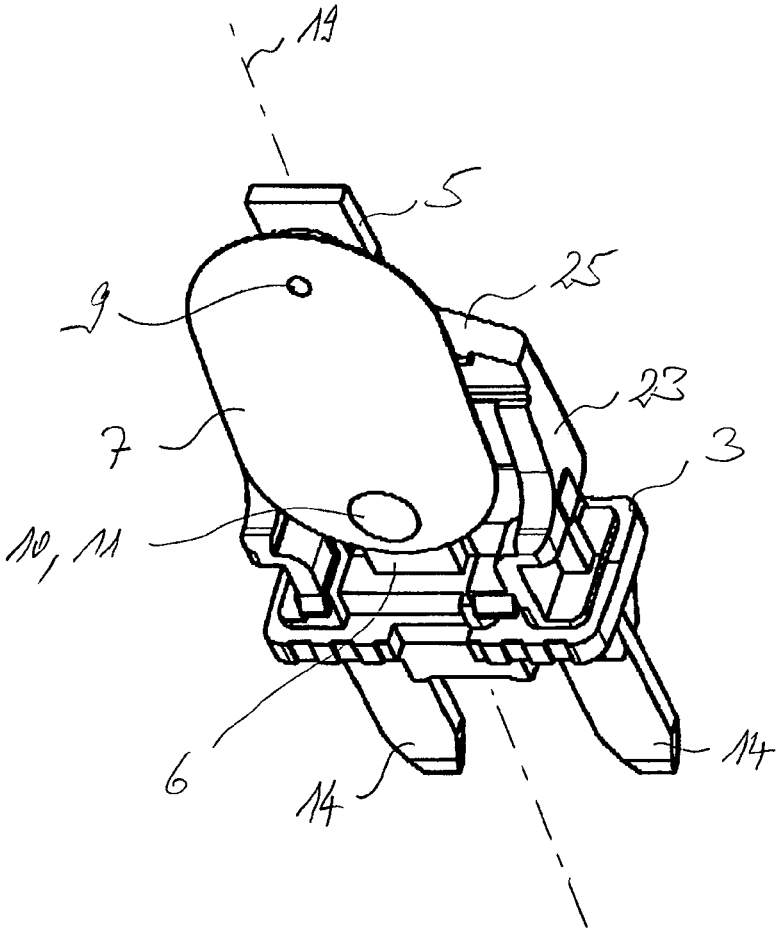
FIG. 5 is a perspective view of the safety switch according to FIG. 1 in the partly assembled state according to FIG. 4, but with an assembled bimetallic snap disk.

FIGS. 5 to 7 show the assembled state with the bimetallic disk 7 arranged between the rivet 10 and the weld plate 11. In the assembled state, the oval bimetallic disk 7 is centered in terms of its longitudinal extension with the central axis 19 (FIG. 5) and is thus aligned in the longitudinal direction 20 of the safety switch 1 and the contact arms 5 and 6 thereof. The end of the bimetallic snap disk 7 held on the contact arm 6 by the rivet 10 and the weld plate 11 forms its fixing point 10, 11 at the corresponding contact arm 6, while the opposite free end of the bimetallic snap disk 7 carries the moving contact 9 (FIGS. 6 and 7). As can be seen from FIGS. 6 and 7, the conical spring 28 and the PTC resistor 29 are located between the fixing point 10, 11 of the bimetallic snap disk 7 and the contacts 8, 9. As can be seen, the PTC resistor 29 directly contacts the bimetallic snap disk 7 in a planar manner. The base-side spring end 28*a* of the conical spring 28 contacts the contact arm 5 of the fixed contact 8 and, in doing so, lies in the receiving pocket 27 of the housing base 3. With its opposite, apex-side spring end 28*b*, the conical spring contacts the PTC resistor 29 as centrally as possible, where it forms a central tilt point 30.

In its normal position according to FIG. 6 with the bimetallic snap disk 7 running at an incline in the longitudinal direction 20, the moving contact 9 contacts the fixed contact 8 at an incline and under bias. An electrically conductive connection between the plug-in contacts 14 is thus produced via the contact arms 5 and 6, the fixed contact 8, the moving contact 9 and the rivet 10. The safety switch 1 is thus electrically conductive in the normal state. The bimetallic snap disk 7 is formed in such a way that it suddenly changes its shape when its temperature exceeds a trigger temperature, for example of 1700° C., predefined by the design. As a result of this change in shape, the moving contact 9 lifts from the fixed contact 8 so that the electrical connection existing between the fixed contact arm 5 and the bimetallic contact arm 6 is disconnected. FIG. 7 shows the safety switch 1 in the triggered position. The change in shape to the bimetallic snap disk 7 is reversible according to the temperature thereof, such that it springs back into the normal position (FIG. 6) when its temperature falls below a return temperature predefined by the design.

In the event of triggering, when the electrical connection between the fixed contact arm 5 and the bimetallic contact arm 6 is interrupted due to the deflection of the bimetallic snap disk 7, a high-resistance electrical connection between the contact arms 5 and 6 is maintained via the PTC resistor 29 and the conical spring 28. Provided the overload condition once the safety switch 1 has been triggered and thus a flow of current between the fixed contact arms 5 and 6 is maintained, the bimetallic snap disk 7 is heated due to the thermal loss that is generated in the PTC resistor 29 directly contacting the bimetallic snap disk 7, and the bimetallic snap disk 7 is prevented from cooling below the return temperature. Once triggered for the first time, the safety switch 1 thus remains in the triggered state as long as the overload condition continues to exist.

A ceramic-based non-linear thermistor is used for the PTC resistor 29. This heats up as a result of the current flow and limits the current to approximately 100 mA. This corresponds merely approximately to between one third and one quarter of the amperage that is required in the known solutions. In addition, a relatively loose correlation between the applied voltage and the output power is produced due to the non-linearity of the resistor 29. For the primary application in an on-board power supply system of a motor vehicle, the supplied temperature and therefore the power remain relatively constant over the total conventional voltage range from approximately 11 V to 14.5 V. This is a particular preference, accompanied by the advantage of a reduced power output. This in turn enables the use of a housing cover (housing cap) 4, which consists of plastics material, is therefore electrically insulating, and is snapped onto the housing base 3 in the subsequent assembly step. In contrast to this electrically insulating housing cover 4 or a housing cap, metal caps or the like, which may have to be insulated by an additional coating, are always necessary in known solutions due to construction and in particular for temperature reasons.

On the whole, a PTC resistor 29 having a surface temperature of 275° C. is thus preferably selected, which deviates from the standard and appears to be the upper limit for this type of PTC resistor. The surface temperature of PTC resistors of this type used for heating is normally 250° C. at most. Since the PTC resistor 29 contacts the bimetallic snap disk 7 directly and in a planar manner and to this end is pressed against the bimetallic snap disk 7 with a specific bias to ensure effective thermal transfer, a particularly effective thermal transfer as well as a sufficient flow of current through the PTC resistor 29 are thus enabled.

So as to adapt the movement of the bimetallic snap disk 7 during the opening process in the event of triggering, the PTC resistor 29 remains movable, since the conical spring 28 does not contact the resistor 29 over a large area, but in the region of the tilt point 30 and therefore instead in the central region over the small contact area produced thereby. The contact force of the conical spring 28 is dimensioned in such a way that the preferably disk-shaped PTC resistor 29 contacts the bimetallic snap disk 7 effectively and also does not negatively influence the snap behavior thereof.

The compression spring 28 is formed in such a way that it can be pressed together as fully as possible. It is thus taken into account that only a very small amount of space is available in order to position and accommodate the compression spring 28 in the safety switch 1, more specifically between the fixed contact arm 5 and the bimetallic snap disk 7, and that the space is additionally already required in part by the PTC resistor 29. A compression spring 28 with a conical spring body and therefore, in turn, the use of a volute spring (conical spring) is thus particularly advantageous. The conical spring body is produced by continuously changing the coil diameter as the spring wire is wound.

Figure 8:
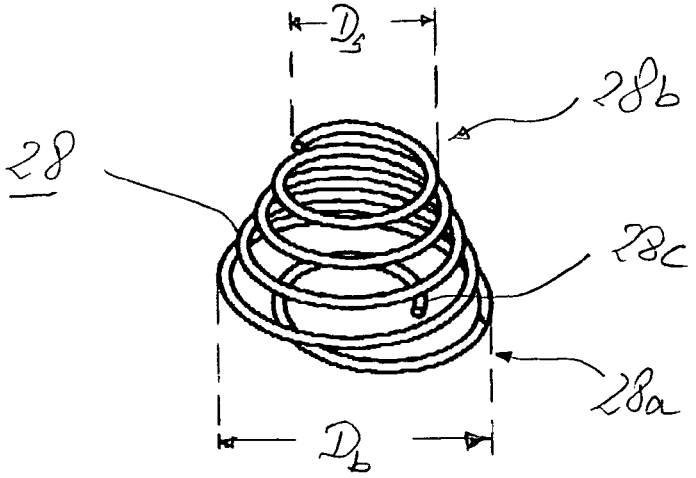
FIG. 8 is a perspective view of the volute spring.

Such a preferred conical spring 28 is shown in FIG. 8. The coils or windings of the conical spring 28 are changed in this case from coil to coil in the longitudinal or axial direction of the spring in such a way that the coils can slide one inside the other as the conical spring 28 is pressed together. To this end, the spring free end 28*c* is suitably curved inwardly at the base-side spring end 28*a* in such a way that the spring height (block length) of the conical spring 28 corresponds practically merely to twice the spring wire thickness when the conical spring is pressed together. The greatest diameter $D_b$ of the conical spring 28 at the base-side spring end 28*a* thereof is approximately 4 mm and corresponds at least approximately to the diameter of the PTC resistor 29 with (4.2±0.1) mm. The conical spring 28 contacts the fixed contact arm 8 at this large coil diameter $D_b$, whereas the smallest coil diameter $D_s$ contacts the PTC resistor 29 at the apex-side spring end 28*b* of the conical spring 28. The PTC resistor remains movable as a result of the merely central contact with formation of the tilt point 30, in such a way that the resistor 29 can advantageously adapt to the movement of the bimetallic snap disk 7.

So as to also train the conical spring 28 so that the feed can be automated, the spring free end 28*c* of the base-side spring end is wound inwardly, preferably in the plane of the last coil of the greatest coil diameter $D_b$. In the event of an automated feed, the conical springs 28 are thus prevented from engaging with their small spring diameter $D_s$ in the large coil diameter $D_b$ of another conical spring 28 and from becoming hooked thereon. In addition, if the conical spring 28 is pressed together completely, only two spring coils thus lie one on top of the other, which is advantageous for spatial reasons.

The disk thickness of the PTC resistor 29 is dimensioned in such a way that it contacts the bimetallic snap disk 7 both when the safety switch 1 is in the switched-on position (FIG. 6) and when the bimetallic snap disk is in the triggered or switched-off position (FIG. 7), without sliding out from the lateral mounting of the receiving pocket 27: it is taken into account as a result of this constructional feature of the provision of the laterally supporting base shells 27*a*, 27*b* that different tolerances are to be expected with different amperages as a result of differently shaped bimetallic snap disks 7. The constructional embodiment of the conical spring 28 also ensures that it does not become rigid, even when pressed together (FIG. 6), and the PTC resistor 29 thus remains movable and does not hinder the snap behavior of the bimetallic snap disk 7. To this end, a disk thickness of the PTC resistor 29 of (1.05±0.06) mm has proven to be optimum. The disk diameter of the PTC resistor 29 is preferably (4.2±0.1) mm in this case.

When the contacts 8, 9 are closed (FIG. 6), the current flows from the contact terminal 14 of the fixed contact arm 5 and the fixed contact 8 to the bimetallic contact 9 and via the bimetallic snap disk 7 and the fixing point 10, 11 to the bimetallic contact arm 6, and from there via the corresponding terminal 14. If the bimetallic snap disk 7 opens the circuit with a sudden movement in the event of an overcurrent, the operating voltage is then applied to the PTC resistor 29 and the current flows from the fixed contact arm 5 via the conical spring 28 to the PTC resistor 29, and from there via the bimetallic snap disk 7 and the fixing point (weld rivet) 10, 11 to the bimetallic contact arm 6. Due to the embodiment and arrangement of the resistor 29 and the compression spring 28 and also in particular the direct contact between the resistor 29 and the bimetallic snap disk 7, a sufficiently large thermal input into the bimetallic snap disk 7 is ensured as a result of the current flow, and therefore the bimetallic snap disk remains above the snapback temperature. This state is maintained until the voltage falls below a specific value (normal case) or falls completely to zero. The current (approximately 100 mA) determined while the snapback temperature is maintained by the resistance of the PTC resistor 29 is relatively low.

The invention therefore relates to a miniature safety switch 1, preferably for use in motor vehicle electronics, containing the housing base 3, from which a fixed contact arm 5 and a bimetallic contact arm 6, which has a moving contact 9 and a bimetallic snap disk 7 attached thereto, are led out, wherein a PTC resistor 29 is brought into direct contact with the bimetallic snap disk 7 by a compression spring 28 and is electrically integrated in such a way that, as a result of the heat generated by the PTC resistor, the bimetallic snap disk 7 remains in the open position thereof in the event of triggering.

The following is a summary list of reference numerals and the corresponding structure used in the above description of the invention:

1 safety switch
2 housing
3 housing base
4 housing cover/cap
5 fixed contact arm
6 bimetallic contact arm
7 bimetallic snap disk
8 fixed contact
9 moving contact
10 rivet
11 weld plate
12 interior
13 underside
14 plug-in contact
15 housing narrow side
16 housing broad side
17 inner end of the fixed contact arm
18 inner end of the bimetallic contact arm
19 central longitudinal axis
20 longitudinal direction
21 transverse direction
22 base
23, 24 base strut
25 base crossmember
26 base cavity
27 receiving pocket
27*a*, 27*b* base shell
28 conical/volute spring
28*a* base-side spring end/coil
28*b* apex-side spring end/coil
28*c* spring free end

29 PTC resistor
30 tilt point
$D_b$ base-side spring/coil diameter
$D_s$ apex-side spring/coil diameter

The invention claimed is:

1. A miniature safety switch for use in motor vehicle electronics, the miniature safety switch comprising:

a housing having a housing base made of an insulating material and a housing cover that can be fitted, or is fitted, on said housing base, said housing base having a base side;

first and second elongate and flat contact arms embedded parallel to one another in terms of a longitudinal direction thereof in said housing base and protrude out at said base side from said housing base;

a fixed contact disposed in said housing and attached to said first contact arm;

a bimetallic snap disk having a moving contact and attached to said second contact arm;

a compression spring being supported on said first contact arm beneath said fixed contact in the longitudinal direction;

a positive temperature coefficient (PTC) resistor being electrically incorporated in such a way that, as a result of heat generated by said PTC resistor, said bimetallic snap disk remains in an open position thereof in an event of triggering, said PTC resistor being brought into direct contact with said bimetallic snap disk by means of said compression spring; and said compression spring being a conical spring having a base-side spring end contacting said first contact arm and an apex-side spring end contacting said PTC resistor.

2. The miniature safety switch according to claim 1, wherein said base side spring end has a relatively large spring diameter and said apex-side spring end has a relatively small spring diameter.

3. The miniature safety switch according to claim 1, wherein said compression spring has a diameter of approximately 2 mm at said base-side spring end thereof and is approximately 4 mm at said apex-side spring end thereof.

4. The miniature safety switch according to claim 3, wherein said PTC resistor is a disk-shaped PTC resistor having a disk diameter corresponding to said diameter of said compression spring at said base-side spring end thereof.

5. The miniature safety switch according to claim 4, wherein:

said disk diameter of said PTC resistor is 4.2±0.1 mm; and said PTC resistor has a disk thickness of is 1.05±0.06 mm.

6. The miniature safety switch according to claim 4, wherein said apex-side spring end of said compression spring contacts said disk-shaped PTC resistor centrally.

7. The miniature safety switch according to claim 1, wherein:

said housing base has a housing crosspiece with a pocket-shaped base contour running in a transverse direction relative to said first contact arm;

said first contact arm carrying said fixed contact is guided through said pocket-shaped base contour of said housing crosspiece; and said base-side spring end is remote from said PTC resistor and said compression spring is inserted via said base-side spring end into said pocket-shaped base contour, where it is supported at least laterally.

8. The miniature safety switch according to claim 1, wherein said bimetallic snap disk is attached to said second contact arm at a fixing point, said PTC resistor being disposed between said fixing point and said moving contact or said fixed contact in the longitudinal direction.

9. The miniature safety switch according to claim 1, wherein said PTC resistor contacts said bimetallic snap disk approximately centrally.

10. The miniature safety switch according to claim 1, wherein said PTC resistor is electrically contacted with said first contact arm via said compression spring and with said second contact arm via said bimetallic snap disk, such that a current flows across said PTC resistor in an event of triggering and heats said PTC resistor.

* * * * *